US009249630B2

(12) United States Patent
Downie et al.

(10) Patent No.: US 9,249,630 B2
(45) Date of Patent: Feb. 2, 2016

(54) DOWNHOLE DRILLING ASSEMBLY

(75) Inventors: Andrew Mcpherson Downie, Fife (GB); Pascal Michel Vitale, Eybens (FR); Bachar Boussi, Denver, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 678 days.

(21) Appl. No.: 13/257,620

(22) PCT Filed: Mar. 19, 2010

(86) PCT No.: PCT/GB2010/000502

§ 371 (c)(1),
(2), (4) Date: Jan. 23, 2012

(87) PCT Pub. No.: WO2010/106335

PCT Pub. Date: Sep. 23, 2010

(65) Prior Publication Data

US 2012/0111640 A1 May 10, 2012

(30) Foreign Application Priority Data

Mar. 20, 2009 (GB) ..... 0904791.1

(51) Int. Cl.

| | |
|---|---|
| ***E21B 17/10*** | (2006.01) |
| ***E21B 10/26*** | (2006.01) |
| ***E21B 4/00*** | (2006.01) |

(Continued)

(52) U.S. Cl.

CPC . *E21B 10/26* (2013.01); *E21B 4/00* (2013.01); *E21B 7/068* (2013.01); *E21B 17/04* (2013.01); *E21B 17/10* (2013.01); *E21B 17/1078* (2013.01); *E21B 17/1092* (2013.01)

(58) Field of Classification Search

USPC ..... 166/241.1, 241.6; 175/325.1, 408, 175/325.2, 325.4, 325.5, 101, 107

See application file for complete search history.

(56) References Cited

U.S. PATENT DOCUMENTS

| | | | |
|---|---|---|---|
| 4,319,649 | A | 3/1982 | Jeter |
| 4,385,669 | A | 5/1983 | Knutsen |

(Continued)

FOREIGN PATENT DOCUMENTS

| | | | |
|---|---|---|---|
| EP | 1398455 | A2 | 3/2004 |
| EP | 1811124 | A1 | 7/2007 |

(Continued)

OTHER PUBLICATIONS

Search Report for PCT/GB2010/000502 (WO2010/106335) dated Dec. 29, 2010; 5 pgs.

(Continued)

*Primary Examiner* — Taras P Bemko

(57) ABSTRACT

A downhole stabilizer (5), such as a drill motor stabilizer, comprises at least one reaming means and/or reinforcing means (10). The present invention also relates to an assembly (30), such as a downhole drilling assembly (31), comprising at least one such stabilizer (5) and/or a drill bit (40,41) comprising a gauge bit (42) at or near a drilling end (45) thereof, and a connection means (46) for connecting the drill bit (40,41) to a drill motor assembly (60), wherein the drill bit gauge (42) comprises a substantially cylindrical portion having a length less than or equal to approximately 1.0 times the nominal bit diameter. The present invention also relates to a novel locking mechanism (80), such as a lock and key mechanism, to allow locking of a shaft (70'), e.g. a motor drive shaft (71'), through or together with a stabilizer (5').

27 Claims, 6 Drawing Sheets

(51) Int. Cl.
*E21B 7/06* (2006.01)
*E21B 17/04* (2006.01)

(56) References Cited

U.S. PATENT DOCUMENTS

| | | | | |
|---|---|---|---|---|
| 4,396,234 | A * | 8/1983 | Garrett | 175/325.2 |
| 4,662,461 | A | 5/1987 | Garrett | |
| 4,877,092 | A | 10/1989 | Helm et al. | |
| 5,050,692 | A | 9/1991 | Beimgraben | |
| 5,186,268 | A | 2/1993 | Clegg | |
| 5,853,053 | A | 12/1998 | Gilchrist et al. | |
| 6,412,579 | B2 | 7/2002 | Fielder | |
| 6,474,425 | B1 | 11/2002 | Truax et al. | |
| 2002/0112894 | A1 * | 8/2002 | Caraway | 175/385 |
| 2006/0081402 | A1 * | 4/2006 | Lockwood et al. | 175/374 |
| 2008/0223575 | A1 * | 9/2008 | Oldham et al. | 166/285 |

FOREIGN PATENT DOCUMENTS

| | | | |
|---|---|---|---|
| EP | 1811126 | A1 | 7/2007 |
| EP | 2169178 | A2 | 3/2010 |
| GB | 2121453 | A | 12/1983 |
| GB | 2328964 | A | 3/1999 |
| GB | 2343470 | A | 5/2000 |
| GB | 2441214 | A | 2/2008 |
| GB | 2462813 | A | 2/2010 |
| WO | 99/05391 | A1 | 2/1999 |
| WO | 2004/029402 | A1 | 4/2004 |
| WO | 2004048744 | A2 | 6/2004 |

OTHER PUBLICATIONS

Search Report under Section 17 for Great Britain application No. 1004576.3 searched Jun. 11, 2010; 2 pgs.

Search Report under Section 17 for Great Britain application No. 1104530.9 searched Apr. 20, 2011; 2 pgs.

Search Report under Section 17 for Great Britain application No. 1104535.8 searched Apr. 20, 2011; 2 pgs.

* cited by examiner

DOWNHOLE DRILLING ASSEMBLY

CROSS-REFERENCE TO RELATED APPLICATIONS

This application is the U.S. National Phase of PCT/GB2010/000502 filed Mar. 19, 2010, which claims priority of Great Britain Patent Application 0904791.1 filed Mar. 20, 2009.

FIELD OF INVENTION

The present invention relates to a downhole stabiliser, such as a drill motor stabiliser, and to a downhole assembly comprising such a stabiliser.

The present invention also relates to improved stabilisation devices for drill motors, and particularly, but not exclusively, to stabilisation devices for use with steerable high speed motors for operation in a wellbore.

The present invention also relates to a novel locking mechanism, such as a lock and key mechanism to allow locking of a shaft, e.g. a motor drive shaft, through or together with a stabiliser, e.g. a drill motor stabiliser, and in particular, though not exclusively, for attaching, removing and/or securing a drill bit, such as a short gauge drill bit to/from a lower end of the shaft.

BACKGROUND OF INVENTION

Various types of downhole motors, including positive displacement motors and turbodrills may be suitable to drive a drill bit within a borehole, e.g. during drilling of the borehole. Steerable high speed motors, also known as turbodrills or turbines, are a commonly employed type of downhole motor and have become well known in the field of downhole drilling.

During the development of steerable high speed motors, it was recognised that at high speeds it was necessary that the motor and bit assembly be stabilised in order to reduce or eliminate wellbore tortuosity—commonly known as spiralling. This spiralling motion which can occur at high speeds can seriously reduce the drilling rate, as well as cause excessive wear of the various parts of the motor assembly. This spiralling effect can be particularly severe in the case of certain types of geological formations in which the bore is being formed.

In a typical drilling assembly the drill bit is connected to a motor shaft located inside a motor body.

The direction of formation of the wellbore may be controlled, e.g. by providing a bend, a deviating device, or an eccentric stabiliser, located at a suitable position of the assembly.

During normal drilling the motor body portion is rotated at a lower speed than the speed of the drill bit, thereby mitigating the effect of the deviating device. On the other hand, when directional or lateral drilling is required, the deviating device of the assembly is adjusted in a desired direction and held stationary, with the drill bit being rotated at high speed by the downhole motor.

In order to maximise the wellbore deviation, the so-called bit overhang (that is the distance from the lower end, e.g. lower bearing or lower stabiliser, on the motor body housing to the operating face of the drill bit) should be kept to a minimum.

Typically the majority of drill bits comprises a pin connection (Male) with an API thread to mate with a box connection (Female) API thread on the mating component, which may be a drill collar, sub or motor shaft. However, in turbine drilling it has become common practice for the thread connection to be reversed, the bit being provided with the box connection.

In downhole drilling, the terms "short gauge bits" or "long gauge bits" refer to the stabilising or guiding portion of the outer diameter that is used for the purposes of final trimming and guidance of the bit within the hole created by the bit. The gauge may include a sleeve to extend the guiding portion of the bit over a longer length. This sleeve can be made as an integral part of the bit structure. The extended sleeve portion typically has a diameter of +/−1/32" of the nominal bit diameter.

In the art, a short gauge bit is understood to mean a drill bit with an outer cylindrical portion the length of which measures approximately 1 inch to 1.0 times the nominal bit diameter. This contrasts with the so-called long gauge bits which may have cylindrical portions the lengths of which are in excess of 1 times the bit diameter. Furthermore, the so-called long gauge bits are often fabricated from separate pieces and have a short cylindrical portion, which forms part of the bit head and a second cylindrical portion formed from a separate sleeve and joined to the bit head. It is understood that the two cylindrical portions combine such that the cylindrical portion length is in excess of 1 times the nominal bit diameter. The two cylindrical portions are substantially of the same diameter but can be slightly different; approximately 1/32" difference is possible due to normal manufacturing tolerance variations.

Short gauge bits have been used in drilling assemblies. However, known assemblies comprising a short gauge bit involved the use of a stabiliser between the gauge bit and the end of the motor body. While this type of arrangement is effective in stabilising the bit, the bit overhang is increased significantly thereby reducing the steerability of the motor assembly.

Current turbines tend to employ drilling bits having long total gauge lengths, typically from 1 times the nominal bit diameter to more than 2 times the nominal bit diameter. This has become necessary to ensure a smooth wellbore is produced. However, this introduces a risk that the drill bit may become stuck in the wellbore, and also increases the cost of the drill bit.

Recent developments in drill bits have led to motor assemblies which no longer require the presence of a bit box between the lower end of the motor shaft and the drill bit. Such an arrangement is described in U.S. Pat. No. 5,853,053 (GILCHRIST et al.). While the assembly disclosed therein provides a reduction in the bit overhang, some of the associated disadvantages may include premature wear of the stabiliser, and a relatively high risk that the long gauge drill bit may become stuck in the borehole.

It is an object of at least one embodiment of at least one aspect of the present invention to obviate and/or mitigate one or more disadvantages in the prior art.

It is an object of at least one embodiment of at least one aspect of the present invention to provide a downhole drill motor stabiliser comprising reaming features or reaming means provided at or near at least a front portion of at least one blade of the stabiliser.

It is an object of at least one embodiment of at least one aspect of the present invention to provide a drill bit comprising a gauge bit, e.g. a short gauge bit, and a connection means for connecting the drill bit to a drill motor assembly.

It is an object of at least one embodiment of at least one aspect of the present invention to provide a downhole drilling assembly comprising an improved stabiliser, and optionally a drill bit such as a short gauge drill bit, and a motor assembly.

It is an object of at least one embodiment of at least one aspect of the present invention to provide a locking means or lock and key mechanism for locking of a motor drive shaft through or together with a motor stabiliser, and beneficially allowing ease of handling, and attachment and/or removal of a drill bit to/from the motor drive shaft.

It is an object of at least one embodiment of at least one aspect of the present invention to provide a downhole drilling assembly comprising the locking means or lock and key mechanism.

SUMMARY OF INVENTION

According to a first aspect of the present invention there is provided a stabiliser comprising at least one reaming means and/or reinforcing means.

In the art the term stabiliser is known and understood. However, it will be understood that other equivalent terms may be used in the art, e.g. centraliser.

The stabiliser may comprise a downhole stabiliser.

Advantageously, the stabiliser may be a drill motor stabiliser.

The stabiliser may comprise one or more blades, e.g. a plurality of blades, e.g. longitudinally extending blades, on or around an outer surface thereof, e.g. circumferentially spaced.

Alternatively, the one or more blades, e.g. plurality of blades, may be profiled, e.g. oblique or waved relative to an axis of rotation of the stabiliser.

The stabiliser may comprise a cylindrical body, and the outer surface may comprise an outer surface of the cylindrical body.

Each blade may comprise at least one top or outermost portion or surface.

Each blade may also comprise at least one sloped or inclined portion or surface extending between the at least one top or outermost portion or surface of the blade and a body portion or end portion of the stabiliser, e.g. of the cylindrical body, at or near a first or lower or drilling end and/or a second or upper end thereof.

Typically, each blade may comprise at least one edge between the at least one top portion or surface and the at least one sloped portion or surface thereof.

Beneficially, the reaming means may be provided on at least one blade of the stabiliser.

The stabiliser may comprise at least one first reaming means and/or reinforcing means provided at least at or near a first or lower end portion of the stabiliser, which first end is nearest a drill end thereof, in use. By such provision, any variation and/or imperfection in the drilling profile arising from displacement of the drill bit from a central axis during drilling may be corrected by reaming of the wellbore by the centraliser, thereby improving the quality of the wellbore.

The stabiliser may further comprise at least one second reaming means and/or reinforcing means provided at least at or near a second or upper end portion of the stabiliser, which second end is farthest from a drill end thereof, in use. By such provision, further reaming of the wellbore may be performed by rotation of the stabiliser during removal of a drilling assembly or 'Pulling Out Of Hole' ('POOH').

Preferably, the first and/or second reaming means may comprise means, e.g. reaming blocks, protruding or extending at least partially from a top surface of at least one blade over or onto a sloped surface thereof.

The first and/or second reaming means may each have an outermost surface which may be substantially planar. A portion of the outermost surface of the first and/or second reaming means may be substantially flush or level with the outermost surface of the blade(s) upon which they are provided. A further portion of the outermost surface of the first and/or second reaming means may be provided radially outward of the respective inclined surface.

The stabiliser may further comprise at least one third reaming means and/or reinforcing means provided on at least one portion, e.g. the sloped portion, of at least one blade. By such provision, in use, the sloped portion of a blade may be protected from excessive or premature wear, e.g. by "undercutting".

The stabiliser may further comprise at least one fourth reaming means and/or reinforcing means provided on at least a top portion or surface of at least one blade thereof.

Typically, the third and fourth reaming means and/or reinforcing means may be substantially level or flush with an outer surface at least one blade of the stabiliser.

The stabiliser may further comprise at least one fifth reaming means and/or reinforcing means provided at least partially along at least one longitudinal edge of at least one blade.

Conveniently, the at least one fifth reaming means and/or reinforcing means may provided at least partially along or near a longitudinal edge of at least one blade facing substantially towards a direction of rotation of the stabiliser, in use. By such provision, reaming performance may be improved and/or the at least one blade may be protected from excessive or premature wear, e.g. by "undercutting".

Typically, the first, second, third and fifth reaming means and/or reinforcing means may comprise blocks and/or may be made from a diamond-impregnated material, e.g. a diamond-impregnated tungsten carbide material.

Typically, the fourth reaming and/or reinforcing means may be made from an optionally diamond-impregnated tungsten carbide material.

Beneficially, the fourth reaming means and/or reinforcing means may comprise blocks, e.g. a mixture of shaped blocks, which blocks may be made from a tungsten carbide material and/or from a diamond-impregnated tungsten carbide material.

Reaming blocks or reinforcing blocks made from different materials may be provided with different shapes.

Typically, reaming blocks made from a diamond impregnated tungsten carbide material are provided in a circular, hexagonal, or octagonal shape, and reinforcing blocks made from a non-reinforced tungsten carbide material may be provided in a rectangular shape.

Preferably, the reaming means and/or reinforcing means may be provided on one blade of the stabiliser.

Alternatively, the reaming means and/or reinforcing means may be provided on more than one blade, e.g. every blade, of the stabiliser.

Preferably, the reaming means and/or reinforcing means may be provided on the same blade of the stabiliser.

Alternatively, each of first, second, third, fourth and fifth reaming means and/or reinforcing means may be provided independently on one or more blades of the stabiliser.

The first, second, third, fourth and/or fifth reaming means and/or reinforcing means may comprise a combined reaming and reinforcing means.

It is understood that the reaming features provided on the stabiliser of the present invention may fulfil their function when the stabiliser is in rotational motion, e.g. during normal drilling mode.

Advantageously, the first, second, third, fourth and/or fifth reaming means and/or reinforcing means may be made of a material harder than a/the body of the stabiliser.

Typically, the stabiliser may be made from a low carbon alloy steel, e.g. a "AISI4145" steel.

Advantageously, the stabiliser may be a downhole drill motor stabiliser.

According to a second aspect of the present invention there is provided a drill bit comprising a gauge bit at or near a drilling end thereof, and a connection means for connecting the drill bit to a drill motor assembly, wherein the drill bit gauge may comprise a substantially cylindrical portion having a length less than or equal to approximately 1.0 times the nominal bit diameter, and typically in the range of 1 inch to 1.0 times the nominal bit diameter.

By such provision the drill bit may be termed a "short gauge bit".

The drill bit gauge may have a length in the range of 1" to 8", typically 2" to 6".

Beneficially, the drill bit may be devoid of a bit sleeve. By such provision the drill bit may rely only on the integral matrix gauge for stabilisation. Further, the bit overhang may be reduced significantly thereby improving the steerability of the motor assembly and diminishing the likelihood of the drill bit becoming stuck. Further still, in the event that the drill bit becomes stuck, the force required to free the drill bit may be reduced. In the event that the drill bit may not be freed, repetitive application of pulling and/or jarring force on the drill bit may cause the drill bit to break, thereby avoiding the need to abandon a section of the bottom hole assembly and/or of the wellbore, thus reducing operating costs in such circumstances.

The connection means, e.g. a thread connection, may connect the drill bit to a motor shaft of the drill motor assembly.

Typically, the connection means, e.g. a thread connection, may comprise an externally threaded pin configured for engaging and connecting with a receiving portion, e.g. an internal thread, of a lower end portion of the shaft. By such provision, the need for a connector, e.g. a bit box, between the drill bit and the end of the drill motor assembly, e.g. motor shaft, is eliminated.

Conveniently, the drill bit may further comprise a neck portion provided, e.g. at or near an upper end of the gauge bit to allow gripping, e.g. by a bit gripper.

Typically, the drill bit may be made from a diamond-impregnated carbide material with a suitable binder material.

According to a third aspect of the present invention there is provided an assembly, such as a downhole assembly, comprising at least one stabiliser according to the first aspect of the present invention, and/or comprising a drill bit according to the second aspect of the present invention.

Advantageously the assembly may comprise a drilling assembly.

The assembly may further comprise a drill motor assembly.

Preferably, the stabiliser may be provided at a lower end of the drill motor assembly, i.e. an end nearest a drill end thereof.

Typically, the drill motor assembly may comprise a tubular motor body portion adapted for selective rotational movement, a motor shaft provided within or inside the tubular motor body portion, and a drill bit attachment means provided at or near a lower end portion of the motor shaft.

Typically also, the tubular motor body portion may be attached and/or rotationally connected to the stabiliser. By such provision, rotational motion of the motor body portion may cause rotational motion of the stabiliser, e.g. during normal drilling. Conversely, absence of rotational motion of the motor body portion e.g. during directional or lateral drilling, may cause the stabiliser to remain stationary in relation to the motor shaft.

Typically, a lower end portion of the shaft may be provided with a receiving portion, e.g. an internal thread into which is received the connection means, e.g. a thread connection such as an externally threaded pin of the drill bit.

The assembly may be devoid of a connector, e.g. a bit box, between the drill bit and a lower or drilling end of the drill motor assembly, e.g. motor shaft.

Conveniently, a lower end portion of the stabiliser may be substantially level or flush with a lower end portion of the motor shaft and/or motor body portion.

Conveniently, the drill bit may further comprise a neck portion provided, e.g. at or near an upper end of the gauge bit to allow gripping, e.g. by a bit gripper.

The shape of the stabiliser may be substantially concentric in relation to the motor shaft and/or motor body portion.

Alternatively the shape of the stabiliser may be acentric or eccentric in relation to the motor shaft and/or motor body portion.

The external diameter of the stabiliser may be substantially identical to the full gauge diameter of the drill bit, i.e. 0 to −⅛", of the nominal hole size.

Alternatively, the stabiliser may display an offset such that at least one offset blade of the stabiliser may sweep a radius equal to or greater than the bit gauge radius. Typically, the offset radius may be 0 to +3 mm of the bit gauge radius.

The drill motor assembly may comprise a deviating device, e.g. an offset stabiliser or a bend.

Advantageously, when the shape of the stabiliser of the present invention is acentric or eccentric in relation to the motor shaft and/or motor body portion, the acentric or eccentric stabiliser may be alignable with and/or relative to the deviating device. By such provision, deviation of the drilling assembly by the deviating device may be adjusted, improved and/or increased by aligning the acentric or eccentric stabiliser with and/or relative to the deviating device.

Beneficially, the drill bit may be devoid of a bit sleeve. By such provision the drill bit may rely only on the integral matrix gauge for stabilisation, and the bit overhang may be reduced significantly thereby improving the steerability of the motor assembly.

Typically, the drill bit may comprise a substantially cylindrical portion having a length less than or equal to approximately 1.0 times the nominal bit diameter, and typically in the range of 1 inch to 1.0 times the nominal bit diameter. By such provision the drill bit may be termed a "short gauge bit".

The drill bit gauge may have a length in the range of 1" to 8", typically 2" to 6".

Typically, the distance between a lower or drilling end of the motor body, e.g. motor shaft and/or of the stabiliser and the bit gauge may be in the range of 1" to 8", typically 2" to 6".

Typically, the drill bit may be made from a diamond-impregnated carbide material with a suitable binder material.

Typically the drilling assembly may be a downhole drilling assembly.

According to a fourth aspect of the present invention there is provided a lockable means or lock and key mechanism adapted for locking a drive shaft through, together with or relative to a stabiliser.

Beneficially the lockable means is adapted to temporarily and/or releasably lock the drive shaft and the stabiliser.

Advantageously, the drive shaft is a motor drive shaft and/or the stabiliser is a drill motor stabiliser.

By such provision a lower end portion of the shaft provided underneath or inside the stabiliser may be held in position while attaching or detaching a drill bit to/from the shaft.

Typically, the lockable means or lock and key mechanism may comprise a lock means and a key means.

The lock means may comprise at least one opening, aperture or slot provided in or through a portion of the stabiliser, and at least one receiving or lock portion provided on at least one portion of the motor drive shaft.

Conveniently, in use, the or one of the at least one openings of the stabiliser may be aligned with the or one of the at least one receiving or lock portions of the motor shaft.

The at least one opening may be openably covered or protected with covering means, e.g. a flap or cover. Such may seek to prevent, in use, ingress, egress or gathering of debris or drilling particles in or near the opening.

Typically, the key means may comprise at least one handling portion and at least one engaging portion.

Conveniently, the shape and size of the at least one opening portion may be such that the at least one engaging portion of the key means may be inserted therethrough.

Conveniently, the at least one receiving or lock portion of the shaft may be adapted for receiving the at least one engaging portion of the key means.

Typically, the at least one receiving or lock portion of the shaft may comprise e.g. a slot, and the at least one engaging portion of the key means may be, e.g. T-shaped.

Typically, the shaft may be provided with one or more, e.g. two, receiving or lock portions, optionally diametrically opposite one another.

Typically also, the stabiliser may be provided with one or more, e.g. two, openings.

Preferably, the locking means or lock and key mechanism may be adapted for a downhole drill motor assembly.

Preferably, the drill motor stabiliser may be a stabiliser according to the first aspect of the present invention.

According to a fifth aspect of the present invention there is provided a downhole drilling assembly comprising at least one lockable means or lock and key mechanism according to the fourth aspect of the present invention.

Preferably, the downhole drilling assembly may further comprise a stabiliser according to the first aspect of the present invention and/or a drill bit according to the second aspect of the present invention, and optionally a drill motor assembly.

According to a sixth aspect of the present invention there is provided a stabiliser comprising at least one opening, aperture or slot of the lock means of the lockable means or lock and key mechanism according to the fourth aspect of the present invention.

Preferably, the stabiliser is a stabiliser according to the first aspect of the present invention.

According to a seventh aspect of the present invention there is provided a key means for locking a drive shaft through, together with or relative to a stabiliser.

According to an eighth aspect of the present invention there is provided a shaft comprising at least one receiving or lock portion, e.g. a slot, adapted for receiving at least one engaging portion of the key means of the lockable means or lock and key mechanism according to the fourth aspect of the present invention.

BRIEF DESCRIPTION OF DRAWINGS

Embodiments of the present invention will now be described by way of example only, and with reference to the accompanying drawings, which are.

DETAILED DESCRIPTION OF DRAWINGS

Figure 1:
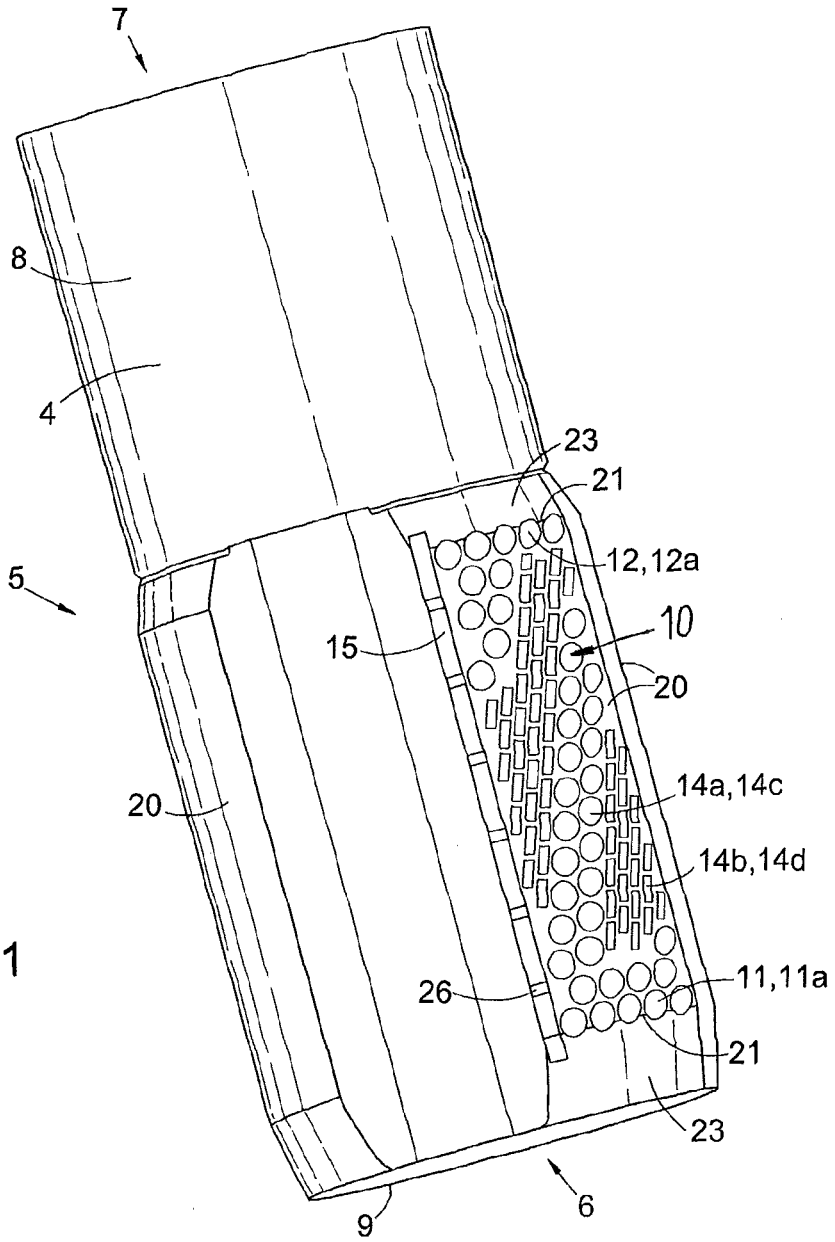
FIG. 1 a side view of a drill motor stabiliser according to a first embodiment of the present invention.

Referring to FIGS. 1 to 4 there is shown a drill motor stabiliser 5 according to a first embodiment of the present invention. The stabiliser 5 comprises reaming means and/or reinforcing means 10.

The stabiliser 5 comprises a plurality of blades 20, e.g. longitudinally extending blades, on or around an outer surface 4 thereof, e.g. circumferentially spaced.

The stabiliser 5 comprises a cylindrical body 8, and the outer surface 4 comprises an outer surface of the cylindrical body 8. Each blade 20 comprises at least one top or outermost portion or surface 22.

Each blade 20 also comprises at least one sloped or inclined portion or surface 23 extending between the at least one top or outermost portion or surface 22 of the blade 20 and a body portion 8 or end portion 9 of the stabiliser 5, e.g. of the cylindrical body, at or near a first or lower or drilling end 6 and/or a second or upper end 7 thereof.

Typically, each blade 20 comprises at least one edge 21 between the at least one top portion or surface 22 and the at least one sloped portion or surface 23 thereof.

Beneficially, the reaming means and/or reinforcing means 10 are provided on at least one blade 20 of the stabiliser 5.

The stabiliser 5 comprises first reaming means 11 provided at least at or near a first or lower end portion 6 of the stabiliser 5, which first end 6 is nearest a drill end thereof, in use.

The stabiliser 5 further comprises second reaming means 12 provided at least at or near a second or upper end portion 7 of the stabiliser 5, which second end 7 is farthest from a drill end thereof, in use.

Figure 2:
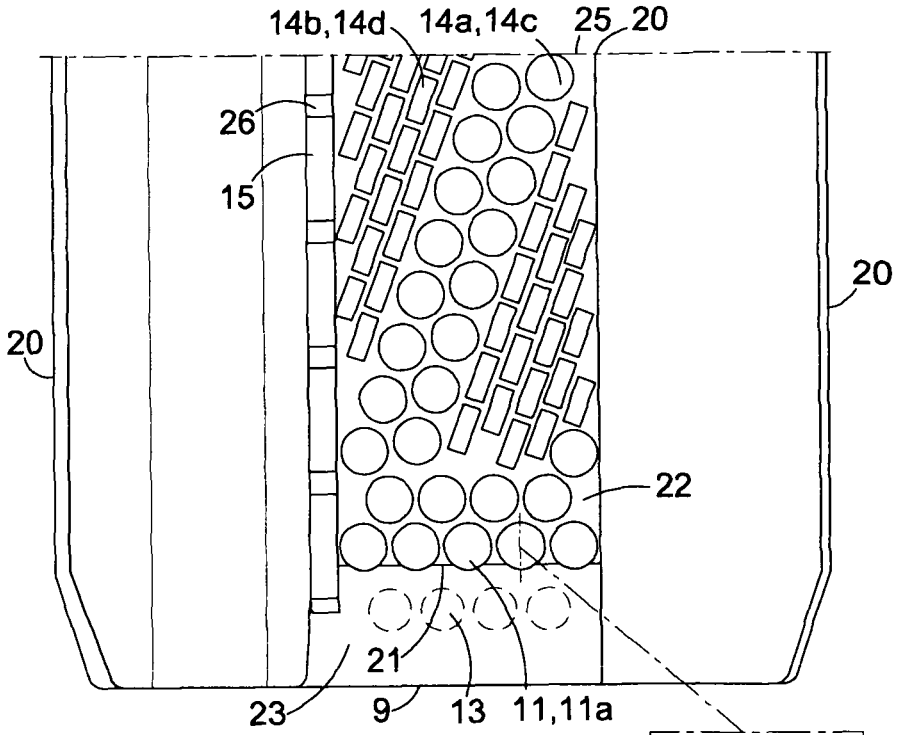
FIG. 2 an enlarged side view of a drilling end of the stabiliser of FIG. 1.
Figure 2A:
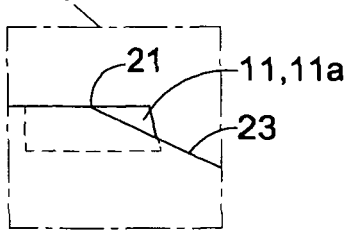
FIG. 2*a* an enlarged cross-sectional view of part of the drilling end of FIG. 2.
Figure 3:
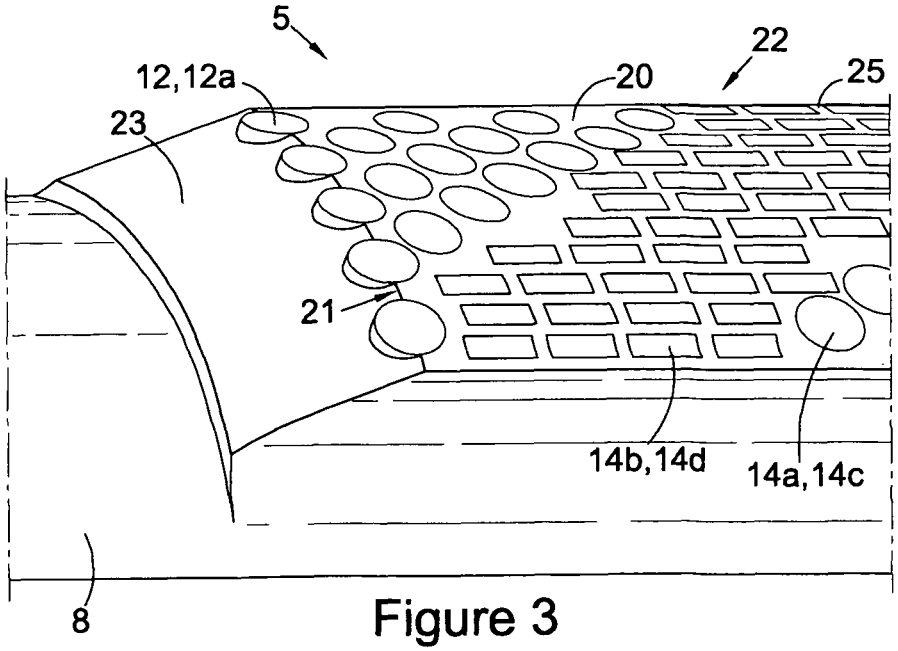
FIG. 3 a perspective view of an upper part of the stabiliser of FIG. 1.

As can be seen from FIGS. 2 and 3, in this embodiment first and/or second reaming means 11,12 comprise reaming blocks 11*a*, 12*a* protruding or extending at least partially from an end of a top surface 22 of at least one blade 20 over or onto a sloped surface 23 thereof.

The first and/or second reaming means 11,12 each have following has been inserted—and is generally parallel to the outermost surface 22 of the blade(s) 20. A portion of the outermost surface of the first and second reaming means 11,12 is substantially flush or level with the outermost surface 22 of the blade(s) 20 upon which they are provided. A further portion of the outermost surface of the first and/or second reaming means 11,12 is provided radially outward of the respective inclined surface 23.

In another embodiment, the stabiliser 5 further optionally comprises third reaming means or reinforcing means 13 provided on at least one portion, e.g. the sloped portion 23, of at least one blade 20. By such provision the sloped portion 23 of a blade 20 is, in use, protected from excessive or premature wear, by e.g. "undercutting".

The stabiliser 5 further comprises fourth reaming means 14*a* or reinforcing means 14*b* provided on at least a top portion or surface 22 of at least one blade 20 thereof.

Typically, the third 13 and fourth 14*a*, 14*b* reaming and/or reinforcing means are substantially level or flush with an outer surface 25 at least one blade 20 of the stabiliser 5.

As shown in FIGS. 1 and 2, the stabiliser further comprises at least one fifth reaming means and/or reinforcing means 15 provided at least partially along a longitudinal edge 26 of at least one blade 20.

In this embodiment, the at least one fifth reaming means and/or reinforcing means 15 is provided at least partially along a longitudinal edge 26 facing substantially towards a direction of rotation of the stabiliser 5, in use. By such provision, reaming performance is improved and/or the at least one blade 20 is protected from excessive or premature wear, e.g. by "undercutting".

Typically, the first 11, second 12, third 13 and fifth 15 reaming and/or reinforcing means comprise blocks and/or are made from a diamond-impregnated material, e.g. a diamond-impregnated tungsten carbide material.

Typically, the fourth reaming means 14*a* or reinforcing means 14*b* are made from an optionally diamond-impregnated tungsten carbide material.

The fourth reaming means 14*a* or reinforcing means 14*b* comprise blocks 14*c* made from a diamond-impregnated tungsten carbide material and blocks 14*d* made from a tungsten carbide material.

In this embodiment, reaming blocks 14*c* or reinforcing blocks 14*d* made from different materials are provided with different shapes.

Reaming blocks 14*c* made from a diamond-impregnated tungsten carbide material are provided in a circular, hexagonal, or octagonal shape, and reinforcing blocks 14*d* made from a non-reinforced tungsten carbide material are provided in a rectangular shape.

In this embodiment, the reaming and/or reinforcing means 11,12,13,14*a*,15 comprise a combined reaming and reinforcing means, e.g. provide both a reaming and reinforcing function, whereas the reinforcing means 14*b* provide a reinforcing function.

In this embodiment, the reaming and/or reinforcing means 11,12,13,14*a*,15 and/or the reinforcing means 14*b* are provided on one blade 20 of the stabiliser 5.

In an alternative embodiment, the reaming and/or reinforcing means 11,12,13,14*a*,15 and/or the reinforcing means 14*b* are provided on more than one blade 20, e.g. every blade, of the stabiliser 5.

In this embodiment, the reaming and/or reinforcing means 11,12,13,14*a*,15 and/or the reinforcing means 14*b* are provided on the same blade 20 of the stabiliser 5.

In another embodiment, each of first, second, third, fourth and fifth reaming and/or reinforcing means 11,12,13,14*a*,15 and/or of reinforcing means 14*b* are provided independently on one or more blades of the stabiliser.

It is understood that the reaming means 10 provided on the stabiliser 5 of the present invention may fulfil their function when the stabiliser 5 is in rotational motion, e.g. during normal drilling mode.

The reaming and/or reinforcing means 11,12,13,14*a*,15 and/or the reinforcing means 14*b* are made of a material harder than the material of the body 8 of the stabiliser 5.

Typically, the stabiliser 5 is made from a low carbon alloy steel, e.g. a "AISI4145" steel.

Advantageously, the stabiliser 5 is a downhole drill motor stabiliser.

Figure 5:
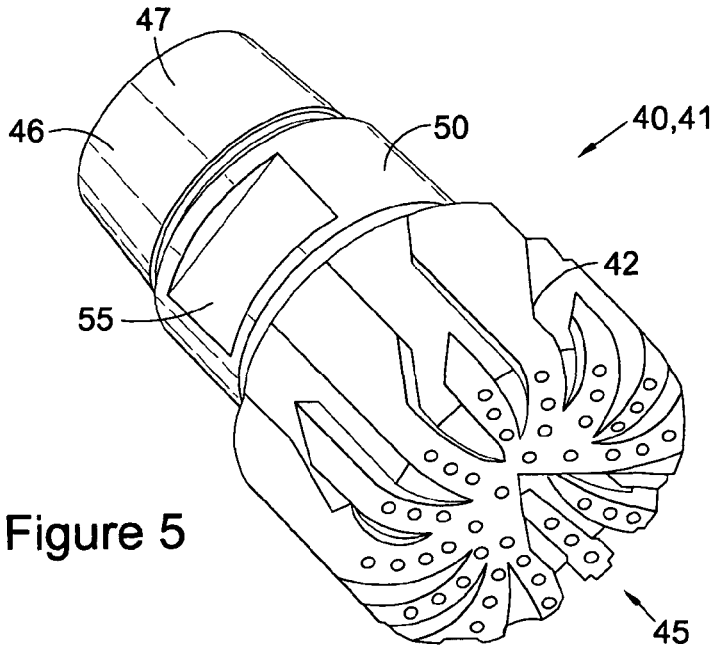
FIG. 5 a perspective view of a drill bit according to a second embodiment of the present invention.

Referring to FIG. 5 there is provided a drill bit according to a second embodiment of the present invention 40 comprising a gauge bit 42 at or near a drilling end 45 thereof, and a connection means 46 for connecting the drill bit 40 to a drill motor assembly. The connection means 46, e.g. a thread connection, are provided to connect the drill bit 40 to a motor shaft of the drill motor assembly.

In this embodiment, the connection means 46 comprises a thread connection, e.g. an externally threaded pin 47 configured for engaging and connecting with a receiving portion, e.g. an internal thread, of a lower end portion of the shaft. By such provision, the need for a connector, e.g. a bit box, between the drill bit 40 and the end of the motor body, e.g. motor shaft, is eliminated.

Conveniently, the drill bit further comprises a neck portion 50 provided at or near an upper end of the gauge bit 42 to allow gripping, e.g. by a bit gripper.

In this embodiment, the neck portion 50 comprises two diametrically opposed flat portions 55 to allow gripping, e.g. by a bit gripper.

Advantageously, the drill bit 40 is devoid of a bit sleeve.

Typically, the drill bit 40 comprises a substantially cylindrical portion gauge 42 having a length less than or equal to approximately 1.0 times the nominal bit diameter, and typically in the range of 1 inch to 1.0 times the nominal bit diameter.

By such provision the drill bit 40 may be termed a "short gauge bit" 41.

The drill bit gauge 42 may have a length in the range of 1" to 8", typically 2" to 6".

Typically, the drill bit 42 may be made from a diamond-impregnated carbide material with a suitable binder material.

Figure 6:
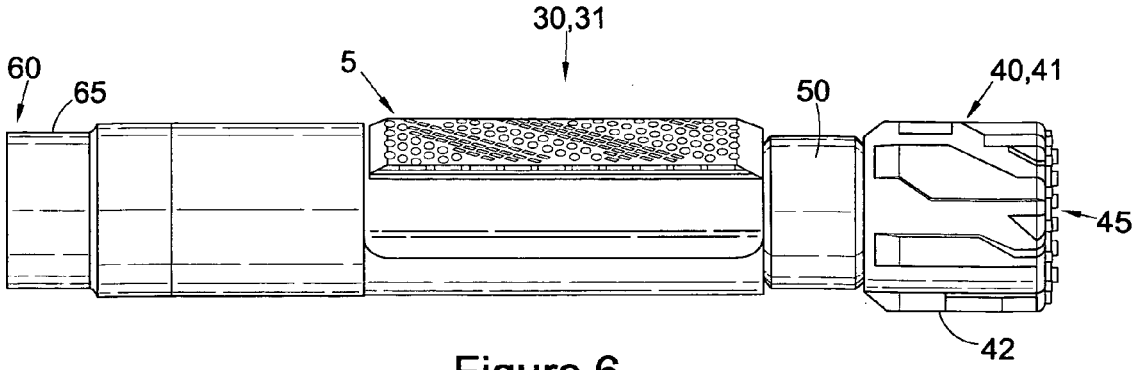
FIG. 6 a side view of a first drilling assembly comprising the stabiliser of FIG. 1 and the drill bit of FIG. 5.
Figure 7:
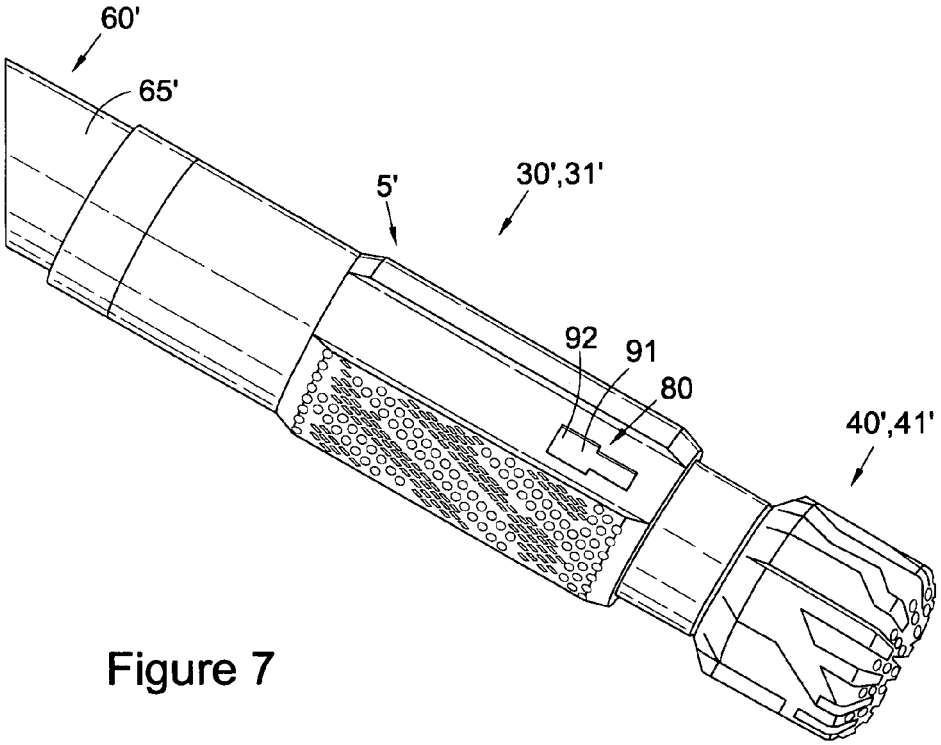
FIG. 7 a side view of a second drilling assembly comprising a modified stabiliser similar to that of the stabiliser of FIG. 1.
Figure 8:
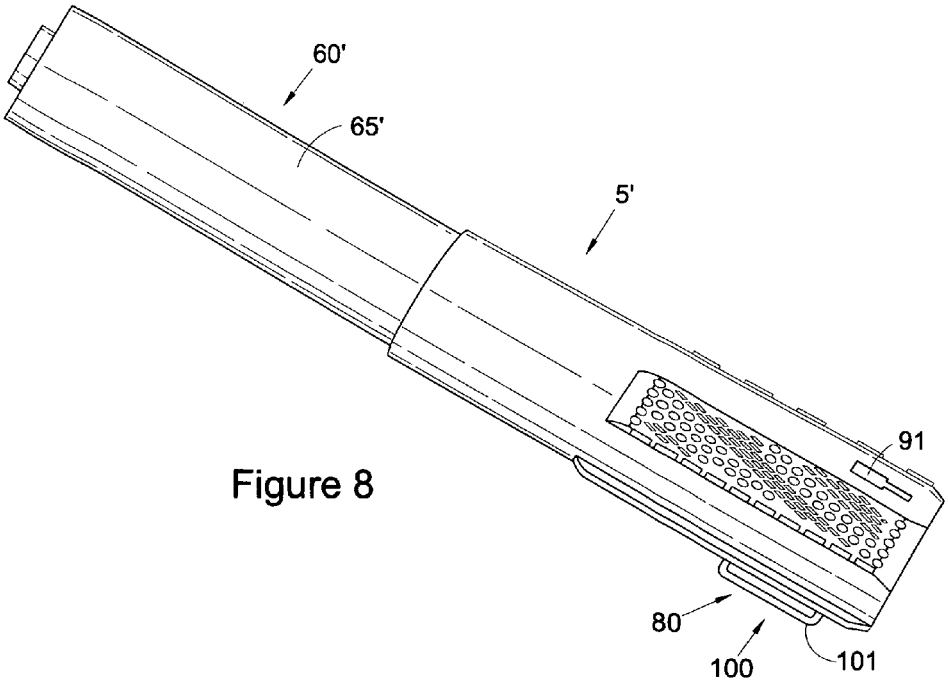
FIG. 8 a further side view of the drilling assembly of FIG. 7 with a drill bit removed and a key means in an engaged position.
Figure 9:
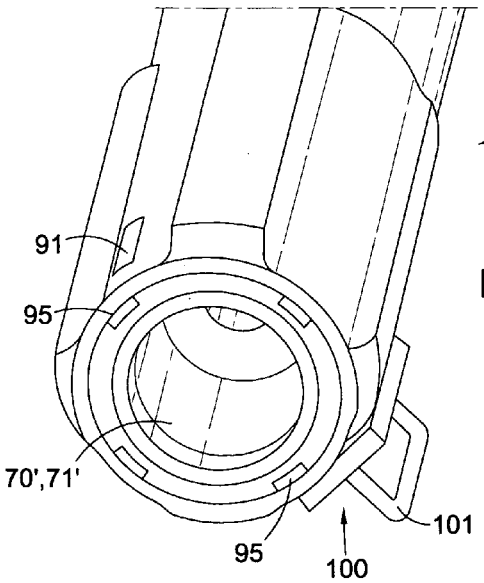
FIG. 9 a front perspective view of a lower end of a motor drive shaft and stabiliser of the drilling assembly of FIG. 7, showing the key means engaged with a locking means.
Figure 10:
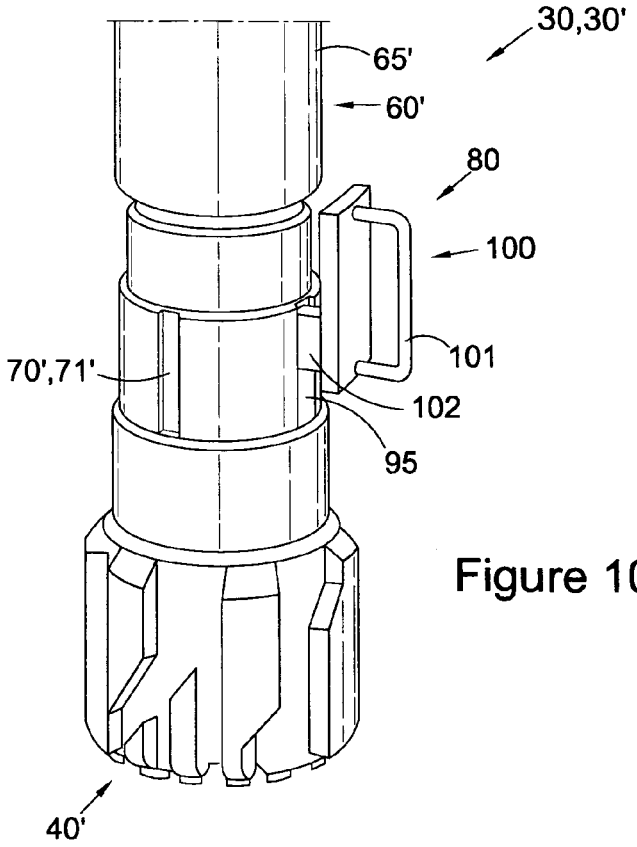
FIG. 10 a cut-away side view of a lower end of the drilling assembly (stabiliser not shown) of FIG. 7, showing the key means engaged with the locking means.

Referring now to FIG. 6 there is provided a drilling assembly 30 comprising a stabiliser 5 according to the first embodiment of the present invention, a drill bit 40 according to the second embodiment of the present invention, and a drill motor assembly 60.

The stabiliser 5 is provided at a lower end of the drill motor assembly 60, i.e. an end nearest a drill end 45 thereof.

Typically, the drill motor assembly 60 comprises a tubular motor body portion 65 adapted for selective rotational movement, a motor shaft provided within or inside said tubular motor body portion, and a drill bit attachment means provided at or near a lower end portion of the motor shaft.

Typically also, the tubular motor body portion 65 is attached and/or rotationally connected to the stabiliser 5. By such provision, rotational motion of the motor body portion 65 causes rotational motion of the stabiliser 5, e.g. during normal drilling. Conversely, absence of rotational motion of the motor body portion 65, e.g. during directional or lateral drilling, causes the stabiliser 5 to remain stationary in relation to the motor shaft.

Typically, a lower end portion of the shaft is provided with an internal thread into which is received an externally threaded pin 47 of the drill bit 40.

The assembly is devoid of a connector, e.g. a bit box, between the drill bit 40 and a lower or drilling end of the motor body 65, e.g. motor shaft.

Conveniently, a lower end portion of the stabiliser is substantially level or flush with a lower end portion of the motor shaft.

Preferably, the drill bit 40 is a short gauge drill bit 41. In the art, a short gauge bit is understood to mean a drill bit with an outer cylindrical portion the length of which measures less than or equal to approximately 1.0 times the nominal bit diameter, and typically in the range of 1 inch to 1.0 times the nominal bit diameter.

Conveniently, the drill bit 40,41 comprises a neck portion 50 to allow gripping, e.g. by a bit gripper.

In one implementation, as shown in FIGS. 1 to 3, the shape of the stabiliser 5 is substantially concentric in relation to the motor shaft.

In this embodiment, the external diameter of the stabiliser 5 diameter is substantially identical to the full gauge diameter of the drill bit 40,41, i.e. 0 to −⅛", of the nominal hole size.

Figure 4:
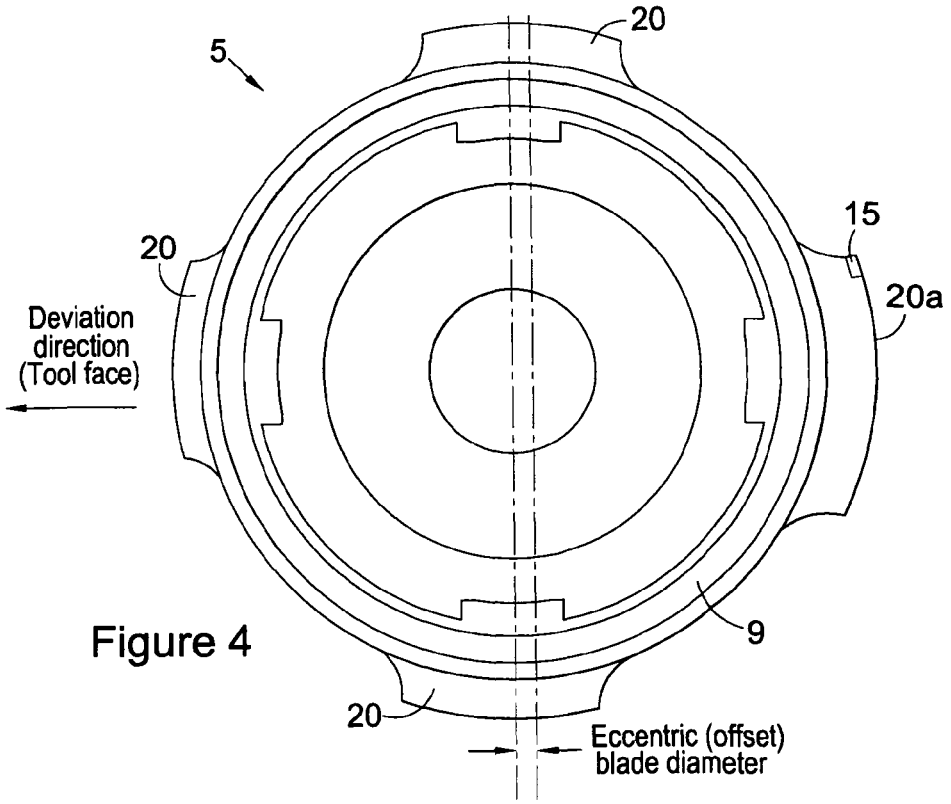
FIG. 4 a side view of an alternative embodiment of the drill motor stabiliser of FIG. 1, showing an eccentric stabiliser.

In another implementation, as shown in FIG. 4, the shape of the stabiliser 5 is acentric or eccentric in relation to the motor shaft. The stabiliser 5 displays an offset such that an offset blade 20*a* of the stabiliser 5 sweeps a radius equal to or greater than the bit gauge radius. Typically, the offset radius is 0 to +3 mm of the bit gauge radius.

Beneficially, the drill bit 40,41 is devoid of a bit sleeve. By such provision the drill bit relies only on the integral matrix gauge for stabilisation and the bit overhang is reduced significantly thereby improving the steerability of the motor assembly.

The drill bit gauge 42 has a length in the range of 1" to 8", typically 2" to 6".

The distance between a lower or drilling end of the motor body 65, e.g. motor shaft and/or of the stabiliser and the bit gauge 42 is in the range of 1" to 8", typically 2" to 6".

Typically, the drill bit 40,41 is made from a diamond-impregnated carbide material with a suitable binder material.

Typically the drilling assembly 30 is a downhole drilling assembly 31.

Referring to FIGS. 7 to 10 there is provided a drilling assembly 30' comprising a stabiliser 5' according to a third embodiment of the present invention. The stabiliser 5' comprises a lockable means or lock and key mechanism 80.

The lockable means or lock and key mechanism 80 is adapted for temporarily and/or releasably locking a drive shaft 70' through or together with a drill motor stabiliser 5'.

Advantageously, the drive shaft 70' is a motor drive shaft 71' and/or the stabiliser 5' is a drill motor stabiliser.

By such provision a lower end portion of the shaft 70' provided underneath or inside the stabiliser 5' may be held in position while attaching or detaching a drill bit 40' to/from the shaft 70'.

Typically, the lockable means or lock and key mechanism comprises a lock means 90 and a key means 100.

The lock means 90 comprises at least one opening, aperture or slot 91 provided in or through a portion of the stabiliser 5', and at least one receiving or lock portion 95 provided on at least one portion of the motor drive shaft 70'.

Conveniently, in use, the or one of the at least one openings 91 of the stabiliser 5' is aligned with the or one of the at least one receiving or lock portions 95 of the motor shaft 70'.

The at least one opening 91 is openably covered or protected with covering means 92, e.g. a flap or cover. Such may seek to prevent, in use, ingress, egress or gathering of debris or drilling particles in or near the opening 91.

Typically, the key means 100 comprises at least one handling portion 101 and at least one engaging portion 102.

Conveniently, the shape and size of the at least one opening portion 91 is such that the at least one engaging portion 102 of the key means 100 may be inserted therethrough.

Conveniently, the at least one receiving or lock portion 95 of the shaft 70' is adapted for receiving the at least one engaging portion 102 of the key means 100.

Typically, the at least one receiving or lock portion 95 of the shaft 70' comprises e.g. a slot, and the at least one engaging portion 102 of the key means 100 is e.g. T-shaped.

Typically, the shaft 70' is provided with one or more, e.g. two, receiving or lock portions 95, optionally diametrically opposite one another.

Typically also, the stabiliser 5' is provided with one or more, e.g. two, openings 91.

Preferably, the drill motor stabiliser 5' is a stabiliser according to the first embodiment of the present invention.

Preferably, the locking means or lock and key mechanism 80 is adapted for a downhole drill motor assembly 31'.

Preferably, the downhole drilling assembly 31' comprises a stabiliser 5', a drill bit 40', and a drill motor assembly 60'.

Figure 11:
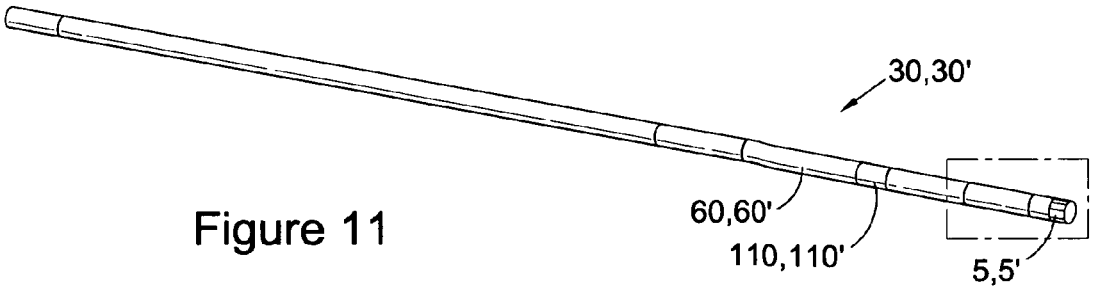
FIG. 11 a side view of the drilling assembly of FIG. 6 or FIG. 7 with a drill bit removed.

Referring now to FIG. 11, there is provided a drilling assembly 30,30' comprising a stabiliser 5,5' according to a first or third embodiment of the present invention, a drill motor assembly 60,60', and a drill bit according to a second embodiment of the present invention (not shown).

In one implementation, the drilling motor assembly 60,60' comprises a deviating device 110,110', e.g. an offset stabiliser or a bend.

When the shape of the stabiliser 5,5' of the present invention is acentric or eccentric in relation to the motor shaft 70,70' and/or motor body portion 65,65', the acentric or eccentric stabiliser 5,5' may be aligned with and/or relative to the deviating device 110,110'. By such provision, deviation of the drilling assembly 30,30' by the deviating device 110,110' may be adjusted, improved and/or increased by aligning the acentric or eccentric stabiliser 5,5' with and/or relative to the deviating device 110,110'. Typically, deviation will occur in a direction opposite the offset blades 20*a* of the stabiliser 5,5'.

It will be appreciated that the embodiments of the present invention hereinbefore described are given by way of example only and are not meant to limit the scope thereof in any way.

The invention claimed is:

1. A downhole stabiliser or centraliser comprising:

a body portion or end portion of the stabiliser;

one or more blades on or around an outer surface of the body portion, the one or more blades comprising a top or outermost surface radially outward from the body portion;

a longitudinally sloped surface extending between the top or outermost surface of the one or more blades and the body portion or end portion of the stabiliser;

at least one first reaming means and/or reinforcing means provided at least at or near a first or lower end portion of the stabiliser nearest a drill end thereof, and/or at least one second reaming means and/or reinforcing means provided at least at or near a second or upper end portion of the stabiliser farthest from a drill end thereof;

wherein the first and/or second reaming means and/or reinforcing means includes an outermost surface that is generally parallel to the top or outermost surface of the one or more blades, and wherein the first and/or second reaming means and/or reinforcing means is partially mounted in each of the top or outermost surface of one of the one or more blades and also the longitudinally sloped surface of the one of the one or more blades such that the first and/or second reaming means and/or reinforcing means extends in a longitudinal direction across an edge defined between the top or outermost surface of the one of the one or more blades and the longitudinally sloped surface.

2. A stabiliser according to claim 1, wherein the stabiliser comprises a drill motorstabiliser.

3. A stabiliser according to claim 1, wherein the stabiliser comprises a plurality of circumferentially spaced blades.

4. A stabiliser according to claim 1, wherein the body portion of the stabiliser comprises a cylindrical body, and the outer surface of the body portion comprises an outer surface of the cylindrical body.

5. A stabiliser according to claim 1, wherein the at least one first and/or second reaming means and/or reinforcing means comprises reaming blocks.

6. A stabiliser according to claim 1, wherein the outermost surface of the at least one first and/or second reaming means and/or reinforcing means is substantially planar.

7. A stabiliser according to claim 6, wherein a portion of the outermost surface of the at least one first and/or second reaming means and/or reinforcing means is substantially flush or level with the outermost surface of the blade(s) upon which the at least one first and/or second reaming means and/or reinforcing means are provided.

8. A stabiliser according to claim 6 or claim 7, wherein a portion of the outermost surface of the at least one first and/or second reaming means and/or reinforcing means is provided radially outward of the respective sloped surface.

9. A stabiliser according to claim 1, wherein the stabiliser comprises at least one third reaming means and/or reinforcing means provided on at least one sloped portion of at least one blade.

10. A stabiliser according to claim 1, wherein the stabiliser comprises at least one fourth reaming and/or reinforcing means provided on at least a top portion or surface of at least one blade.

11. A stabiliser according to claim 9 or claim 10, wherein the at least one third and/or fourth reaming and/or reinforcing means is substantially level or flush with the outermost surface of the one or more blades of the stabiliser.

12. A stabiliser according to claim 10, wherein the fourth reaming and/or reinforcing means comprises blocks and/or are made from a tungsten carbide material.

13. A stabiliser according to claim 1, wherein the stabiliser comprises at least one fifth reaming means and/or reinforcing means provided at least partially along at least one substantially longitudinal edge of at least one blade.

14. A stabiliser according to claim 13, wherein the at least one fifth reaming means and/or reinforcing means is provided at least partially along or near an edge of at least one blade facing substantially towards a direction of rotation of the stabiliser, in use.

15. A stabiliser according to claim 1, wherein the first, second, third and/or fifth reaming means and/or reinforcing means comprises blocks and/or are made from a diamond-impregnated material.

16. A stabiliser according to claim 15, wherein the diamond-impregnated material comprises diamond-impregnated tungsten carbide.

17. A stabiliser according to claim 1, wherein the reaming means and/or reinforcing means is provided on one blade of the stabiliser.

18. A stabiliser according to claim 1, wherein the reaming means and/or reinforcing means is provided on more than one blade of the stabiliser.

19. A stabiliser according to claim 1, wherein the reaming means and/or reinforcing means is provided on the same at least one blade of the stabiliser.

20. A stabiliser according to claim 1, wherein the stabiliser is made from a low carbon alloy steel.

21. A stabiliser according to claim 1, wherein the at least one reaming means and/or reinforcing means comprises a combined reaming and reinforcing means.

22. A stabiliser according to claim 1, wherein the at least one reaming means and/or reinforcing means is made of a material harder than the body of the stabiliser.

23. An assembly comprising at least one stabiliser according to claim 1.

24. An assembly according to claim 23, wherein the assembly comprises a downhole drilling assembly.

25. An assembly according to claim 23, wherein the assembly further comprises a drill motor assembly.

26. An assembly according to claim 25, wherein the stabiliser is provided at a lower end of the drill motor assembly nearest a drill end thereof.

27. A stabiliser according to claim 1, wherein the top or outermost surface of the one or more blades and the outermost surface of the first and/or second reaming means and/or reinforcing means are generally normal to an axis of rotation of the stabiliser.

* * * * *